US006474644B1

(12) United States Patent
Pickle et al.

(10) Patent No.: US 6,474,644 B1
(45) Date of Patent: Nov. 5, 2002

(54) METHOD OF PLAYING A THREE-CARD WAGERING GAME WITH JACKPOT

(75) Inventors: David Brinton Pickle, Las Vegas, NV (US); Warren Joseph Pickle; Susan N. Pickle, both of New Orleans, LA (US)

(73) Assignee: Royal Bonus, LLC, Roanoke, VA (US)

( * ) Notice: Subject to any disclaimer, the term of this patent is extended or adjusted under 35 U.S.C. 154(b) by 0 days.

(21) Appl. No.: 09/639,976

(22) Filed: Aug. 17, 2000

Related U.S. Application Data

(60) Provisional application No. 60/149,240, filed on Aug. 17, 1999.

(51) Int. Cl.[7] ..... A63F 1/00
(52) U.S. Cl. ..... 273/274; 463/13; 273/292
(58) Field of Search ..... 273/274, 292, 273/303; 463/12, 13, 11

(56) References Cited

U.S. PATENT DOCUMENTS 5,022,653 A * 6/1991 Suttle
5,397,128 A * 3/1995 Hesse
5,544,892 A * 8/1996 Breeding
5,597,162 A * 1/1997 Franklin
5,762,340 A * 6/1998 Feola
6,189,888 B1 * 2/2001 Brunelle
6,234,483 B1 * 5/2001 Bucan
6,237,916 B1 * 5/2001 Webb
6,270,079 B1 * 8/2001 Chamberlin

* cited by examiner

*Primary Examiner*—Benjamin H. Layno
*Assistant Examiner*—Vishu K Mendiratta
(74) *Attorney, Agent, or Firm*—Garvey, Smith, Nehrbass & Doody, L.L.C.; Seth M. Nehrbass

(57) ABSTRACT

A method of playing a three-card casino-type card game with jackpot component is disclosed. The game uses a standard fifty-two card deck and predetermined ranking of hands. The method of playing the game includes the player placing an ante wager and optional jackpot wager. Both player and dealer each receive three cards face down, with player allowed to view only his first two cards. Player may choose to fold, surrendering his ante wager or continue play by placing a second wager.

11 Claims, 3 Drawing Sheets

METHOD OF PLAYING A THREE-CARD WAGERING GAME WITH JACKPOT

CROSS REFERENCE TO RELATED APPLICATIONS

This application claims the benefit of U.S. Provisional Application Ser. No. 60/149,240 filed Aug. 17, 1999.

BACKGROUND OF THE INVENTION

The present invention generally relates to wagering card games, particularly those suitable for use in gaming establishments.

The proliferation of casinos and gaming establishments has created a need for new games to attract the potential player. Players are attracted to games that are easy to learn, are fast to play, offer a plurality of wagering options with high winning payouts, and offers a measure of suspense. Players are even more interested in such games if there is a higher "hit" or win rate.

It would therefore be desirable to provide a new card game that is simple to play, and provides a plurality of new wagering options with greater opportunity for player success.

SUMMARY OF THE INVENTION

The wagering card game of the present invention is comprised of a dealer and at least one player where there is a hierarchy of a plurality of possible hands; a predetermined plurality of winning combinations; and, a plurality of wagering combinations and options.

To begin play, a player places an ante wager to play against the dealer. Each player placing an ante wager also has the option to place a jackpot wager. The jackpot wager pays a return of a predetermined amount to the player if player's three-card hand, whether it beats the dealer's hand or not, matches any of a predetermined group of hands.

After ante wagers and jackpot wagers (if any) have been placed, the dealer deals three cards face down to each player and himself. The player is allowed to view only his first two cards, player's third card remaining face down and untouched. The player evaluates his two-card hand and elects whether to continue play or fold. If the player elects to fold then the dealer collects player's ante wager and cards.

If the player elects to continue play, player must place a second predetermined wager, preferably based on player's ante wager, to continue. After all players have decided to place a second wager or fold, the dealer reveals his three-card hand and determines if it equals or exceeds a predetermined rank.

If dealer's hand does not equal or exceed the predetermined rank, player is paid a predetermined sum on his ante wager and player's second wager is returned to player without having been acted upon. If player opted to place a jackpot wager, then player's third card is revealed and dealer determines whether player's three-card hand matches any of the predetermined winning jackpot hands and pays player accordingly.

If the dealer's hand does equal or exceed the predetermined rank, dealer compares his three-card hand to player's three-card hand. If dealer's hand, based on the predetermined hierarchy of hands, is greater than player's hand then player loses and player's ante wager and second wager are collected by the dealer.

If player's hand is greater than dealer's, based on the hierarchy of hands, then player is paid a predetermined sum on player's ante wager and a second predetermined sum on player's second wager.

Whether player's hand wins or loses, if player opted to place a jackpot wager dealer determines whether player's three-card hand matches any of the predetermined winning jackpot hands and pays player accordingly.

In the preferred method of playing the game, a standard 52-card poker deck is utilized. Hands are ranked according to the following hierarchy, where A=ace, K=king, Q=queen, J=jack and the numbers 10 to 2 designate the remaining cards:

| | |
|---|---|
| HIGHEST: | AKQ of the same suit |
| | AK of the same suit with a non-suited Q |
| TRIPS (Three of same rank): | AAA highest ranking trips |
| | KKK next highest ranking trips, |
| | and so on, until |
| | 222 lowest ranking trips |
| PAIR (Two of same rank): | AAK highest ranking pair hand |
| | AAQ next highest ranking pair hand |
| | and so on, until |
| | 223 lowest ranking pair hand |
| HIGH CARD (Hand comprising | A, non-suited K, and Q highest |
| None of the above): | AKJ next highest |
| | AK10 next highest, |
| | and so on, until . . . |
| | 432 lowest ranking hand |

The player makes his ante wager, and if he chooses, a jackpot wager of $1.00. The player and the dealer are dealt three cards face down. The player is allowed to view his first two cards, the player's third card remaining face down and untouched. Player can choose to either fold his hand and lose his ante wager or continue play by placing a second wager that is twice the amount of the ante wager. After players have decided to continue or fold, dealer turns over his three-card hand.

Dealer must have a high card hand of jack or higher to open play. If the dealer cannot open play, the player is paid even money for his ante wager and his second wager is returned having not been in action. If player opted to make a jackpot wager, then dealer turns over the player's third card and ascertains whether player's hand qualifies for a jackpot payout.

The preferred schedule of hands qualifying for jackpot payouts and their corresponding payout amounts, based on a $1.00 jackpot wager, is as follows:

| Player's Three-Card Hand | Jackpot Amount |
|---|---|
| Ace, King, Queen suited with dealer | $10,000.00 |
| Also having Ace, King, Queen suited | |
| Ace, King, Queen suited | $800.00 |
| Ace, King suited with non-suited Queen | $200.00 |
| Three Aces | $150.00 |
| Three, 2's, 3's, or 4's | $50.00 |
| Any other three of a kind | $25.00 |
| Pair of 7's or higher | $5.00 |

Alternatively, the jackpot schedule of hands may include a progressive payout component. Although a variety of hands and corresponding payouts may be used, the preferred progressive payout schedule, based on a $1.00 progressive jackpot wager, is as follows:

| Player's Three-Card Hand | Jackpot Amount |
|---|---|
| Ace, King, Queen suited with dealer Also having Ace, King, Queen suited | 100% |
| Ace, King, Queen suited | $800.00 |
| Ace, King suited with non-suited Queen | $200.00 |
| Three Aces | $150.00 |
| Three, 2's, 3's, or 4's | $50.00 |
| Any other three of a kind | $25.00 |
| Pair of 7's or higher | $5.00 |

If the dealer's hand does qualify to open play, then dealer turns over the player's third card and compares player's three-card hand to dealer's hand. If dealer's hand has a higher rank than the player's hand then the dealer collects player's ante and second wager. If player's hand has a higher rank than dealer's hand then the player is paid even money for his ante wager and the second wager is paid according to the rank of player's winning hand pursuant to the following payout schedule:

| | |
|---|---|
| Ace, King, Queen suited | 30 to 1 |
| Ace, King suited with non-suit Queen | 12 to 1 |
| Three of a kind | 8 to 1 |
| One pair | 2 to 1 |
| All other winning hands | 1 to 1 |

After the dealer has settled all winning and losing wagers, dealer reviews the hands of those players who opted to place a jackpot wager to determine if any such players' hands qualify for a jackpot payout.

DETAILED DESCRIPTION OF THE DRAWINGS

DETAILED DESCRIPTION OF THE INVENTION

Figure 1:
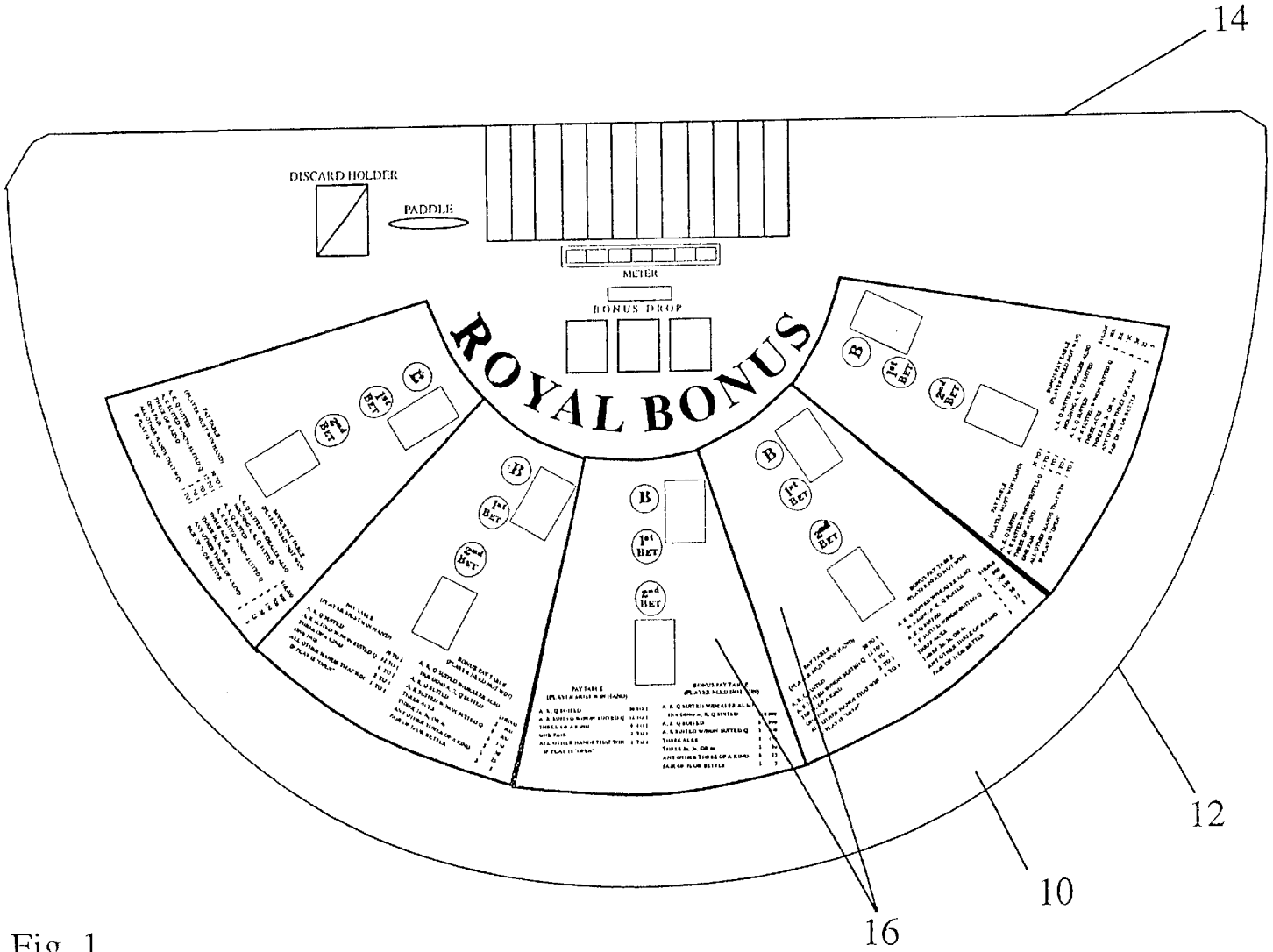
FIG. 1 illustrates the table layout of a playing surface used in the wagering game of the present invention.
Figure 2:
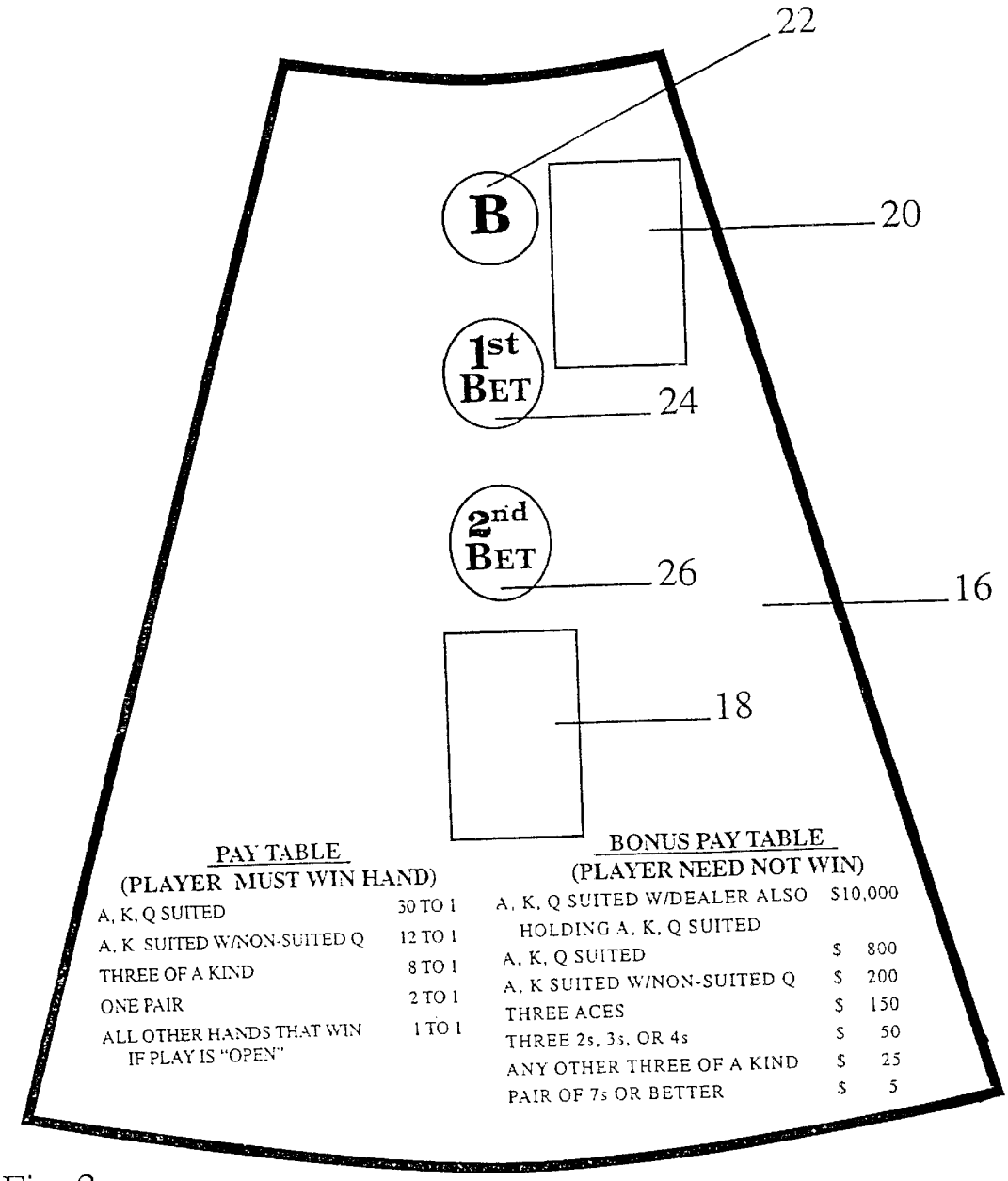
FIG. 2 illustrates one player area of the playing surface shown in FIG. 1.

Referring to FIG. 1, there is shown a typical gaming table layout 10 for use in carrying out the process of playing the present wagering game. The layout 10 represents the style of table surface typically found in casinos. The layout 10 has a curved side 12 for accommodating a number of players along with a straight side 14 where the dealer is located. The layout 10 provides individual player locations 16 for a plurality of players. Each player location 16, as shown in FIG. 2, has marked locations for the placement of player cards 18 and 20,and placement of player wagers 22, 24, and 26 which are more fully described herein below.

In general, the game involves the following sequence of play: (1) each player places an ante wager in order to play; (2) the player also has the option to make a jackpot wager that pays the player a predetermined return if player's hand matches any one of a predetermined group of hands; (2) the dealer, using a standard fifty-two card deck, deals three cards to each player and himself face down; (3) player is allowed to view only the first two cards dealt to him; (4) player may either continue play by making a second wager that is a predetermined amount in relation to player's ante wager or player may fold; (5) if player folds, his ante wager and cards are collected by the dealer; (6) the dealer reveals his three cards and determines whether or not his three-card hand meets a predetermined rank in order to open play; (7) if dealer cannot open play then the dealer pays player a predetermined amount on player's ante wager, returns player's second wager, and, if player placed a jackpot wager, turns over player's third card to determine if player's hand qualifies for a jackpot payoff; (8) if dealer's three-card hand does qualify to open play, dealer turns over player's third card and compares his hand to player's hand; (9) if dealer's hand has a higher rank than player's hand then player's ante wager and second wager are collected by dealer; (10) if player's hand has a higher rank than dealer's hand then player is paid a predetermined sum on his ante wager and a second predetermined sum on his second wager; and, (11) whether player's hand wins or loses, if player opted to place a jackpot wager, dealer determines whether player's three-card hand matches any of the predetermined winning jackpot hands and pays player accordingly.

The game of the present invention, using the preferred method of playing the game will now be described in detail with reference to the FIG. 1 and FIG. 2.

The present invention is intended to encompass a game in which the house or casino acts as the banker, the house collecting all losing wagers and paying all winning wagers. The dealer is a house employee and the players play against the house and not against each other.

The game is preferably played with a single standard fifty-two card poker deck. Although a variety of different hand rankings may be used, in the preferred method of play, hands are ranked according to the following hierarchy, from highest to lowest, where A=ace, K=king, Q=queen, J=jack and the numbers 10 to 2 designate the remaining cards:

| | |
|---|---|
| HIGHEST: | AKQ of the same suit<br>AK of the same suit with a non-suited Q |
| TRIPS (Three of same rank): | AAA highest ranking trips<br>KKK next highest ranking trips,<br>and so on, until<br>222 lowest ranking trips |
| PAIR (Two of same rank): | AAK highest ranking pair hand<br>AAQ next highest ranking pair hand<br>and so on, until . . .<br>223 lowest ranking pair hand |
| HIGH CARD (Hand comprising None of the above): | A, non-suited K, and Q highest<br>AKJ next highest<br>AK10 next highest,<br>and so on, until . . .<br>432 lowest ranking hand |

In the preferred method of play no other traditional type of poker hands are recognized, e.g. straights, flushes and straight flushes.

Figure 3:
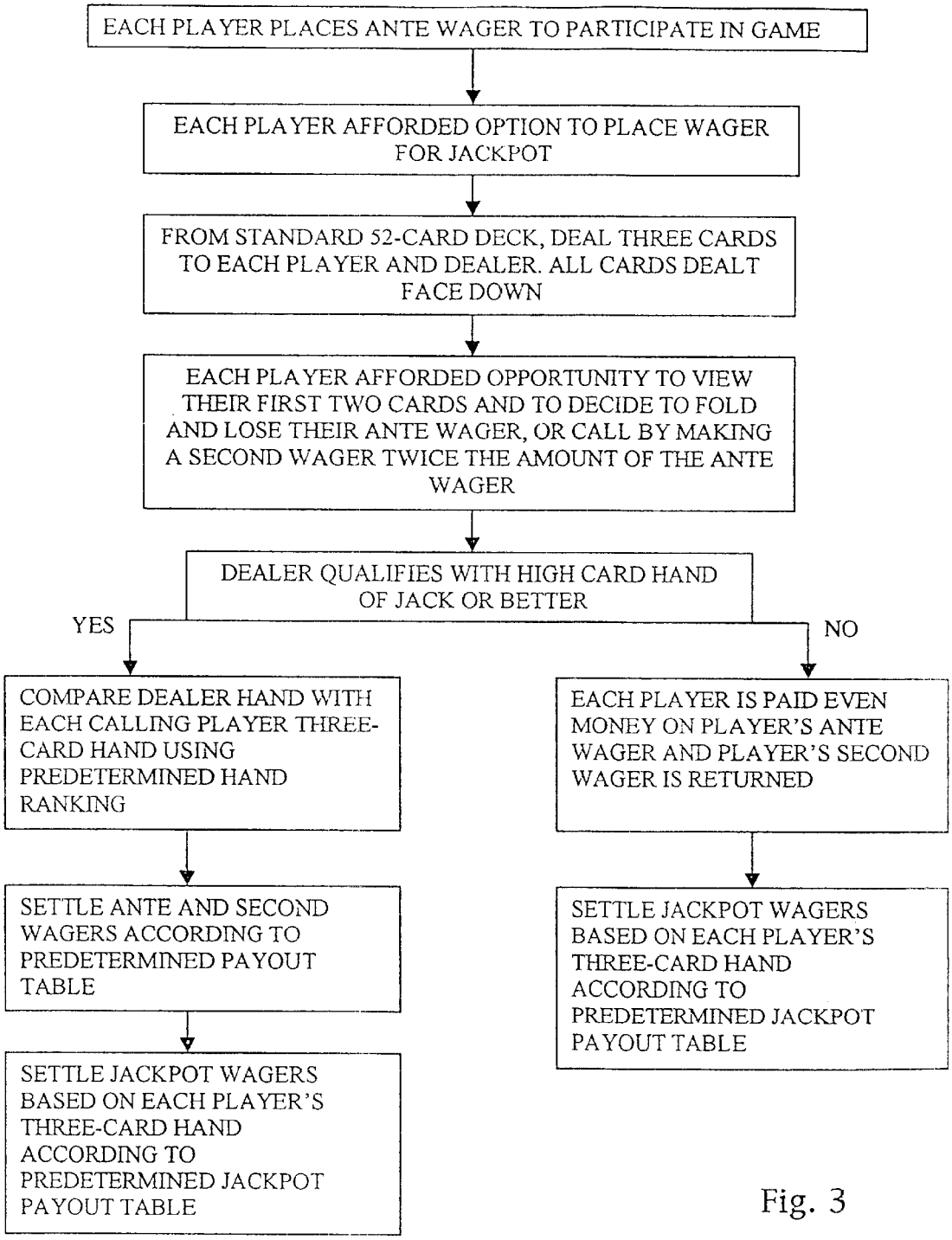
FIG. 3 is a flow chart outlining the steps of the preferred embodiment of the present wagering game.

FIG. 3 presents a flow diagram outlining the steps involved in playing the preferred embodiment.

Referring to FIG. 1 and FIG. 2, to commence play, each player wishing to participate in the game positions himself at one of the player locations 16 on layout 10. The player places an ante wager in wager space 24 of the player location 16 where the player is positioned. The ante wager is preferably at least as large as the house minimum but not larger than the house maximum.

Each player placing an ante wager also has the option of making a jackpot wager in space 22. By making a jackpot wager, the player is betting that his three-card hand, whether ultimately winning or losing, will match one of a predetermined group of hands. In the preferred embodiment, the jackpot wager is not an independent wager. It can only be made if an ante wager is made, and only prior to commencement of play. The preferred jackpot wager is a pre-set amount of $1.00.

The selection of jackpot hands and corresponding payout schedule may be varied in accordance with rules of the game and/or by the casino, however, the preferred hand and payout schedule, based on a $1.00 jackpot wager, is as follows:

| Player's Three-Card Hand | Jackpot Amount |
|---|---|
| Ace, King, Queen suited with dealer | $10,000.00 |
| Also having Ace, King, Queen suited | |
| Ace, King, Queen suited | $800.00 |
| Ace, King suited with non-suited Queen | $200.00 |
| Three Aces | $150.00 |
| Three, 2's, 3's, or 4's | $50.00 |
| Any other three of a kind | $25.00 |
| Pair of 7's or higher | $5.00 |

Alternatively, the jackpot schedule of hands may include a progressive payout component. Although a variety of hands and corresponding payouts may be used, the preferred progressive payout schedule, based on a $1.00 progressive jackpot wager, is as follows:

| Player's Three-Card Hand | Jackpot Amount |
|---|---|
| Ace, King, Queen suited with dealer | 100% |
| Also having Ace, King, Queen suited | |
| Ace, King, Queen suited | $800.00 |
| Ace, King suited with non-suited Queen | $200.00 |
| Three Aces | $150.00 |
| Three, 2's, 3's, or 4's | $50.00 |
| Any other three of a kind | $25.00 |
| Pair of 7's or higher | $5.00 |

The dealer, either by hand or by means of mechanical device, shuffles the cards. After ante wagers and optional jackpot wagers have been made by the players, the dealer announces "No More Bets" and begins the deal. Dealing clockwise, and in alternating fashion, the dealer deals three cards face down to each player and to himself. In dealing the cards to the players, the dealer will place the first two cards dealt to each player in space 18 of the player's location 16 and each player's third card is placed by the dealer in space 20 of player's location. After all cards have been dealt, players are allowed to inspect their first two cards placed in space 18 before them, but should keep their cards hidden from other players. Players are not allowed to touch their third card placed in space 20 before them.

After the players inspect their first two cards they can elect to either fold or continue play. To continue play, a player must place a second wager in space 26 of layout 16 in front of him and return his first two cards to space 18, preferably face down. This second wager is a predetermined amount based on the ante wager and for the preferred method of play is twice the amount of player's ante wager. If a player chooses to fold, all three of his cards, his ante wager, and jackpot wager, if any, are collected by the dealer and the player sits out the remainder of the game.

Once all players have decided to either fold or continue play, the dealer turns over his three cards in front of him. If dealer does not have at least a high card hand with jack or better then play is not open. When dealer's hand does not qualify to open play only the player's ante wager is in action. Dealer pays each remaining player even money (1 to 1) on player's ante wager and returns player's second wager, there having been no action on this wager. For those players who placed a jackpot wager, the dealer then turns over each such player's three cards (the first two in space 18 and the third in space 20 in front of the player) to ascertain if any player's hand qualifies for a jackpot payout. If a player has a hand that matches any of the predetermined hands as set forth in the schedule of jackpot hands then player is paid the corresponding sum for having achieved that hand.

If the dealer does have at least a high card hand of jack or better then play is open. The dealer turns over each player's three cards (the first two in space 18 and the third in space 20 of player's location 16) and compares each player's three-card hand to dealer's hand. Based on the ranking hierarchy as stated above, if dealer's hand is higher than player's hand then dealer will collect player's ante wager and second wager.

If play is open and a player's hand is of higher rank than the dealer's hand, the dealer pays the player even money for the player's ante wager (1 to 1) and the player's second wager is paid a predetermined amount based on the rank of player's hand. In the preferred method of play, the second wager of a winning player is preferably paid according to the following table:

| | |
|---|---|
| Ace, King, Queen suited | 30 to 1 |
| Ace, King suited with non-suit Queen | 12 to 1 |
| Three of a kind | 8 to 1 |
| One pair | 2 to 1 |
| All other winning hands | 1 to 1 |

If a player's hand is the same rank as the dealer's hand, there is a push, and player retains his ante wager and second wager.

After the dealer has collected or paid wagers from open play, the hand of each remaining player who placed a jackpot wager is further reviewed by the dealer to ascertain if it qualifies for a jackpot payout. The player's hand does not have to beat the dealer's hand to qualify for a jackpot payout. The same jackpot schedule of hands and corresponding payouts as set forth above will apply. The dealer then collects the remaining jackpot wagers (jackpot wagers are never returned to the player) and another game begins.

From the above description of the preferred method of play, those skilled in the art will appreciate that modifications may be made without departing from the scope of the present invention. For example, the layout 10 shown in FIG. 1 is preferred. However, variations in the layout are acceptable for use in playing the game of the present invention. Further, space 22 of the player location 16, used for the placement of the jackpot wager, could be replaced with a slot or mechanical device for receiving a wager token, which said slot, by illumination or other means would confirm player's jackpot wager and/or automatically tally jackpot wagers received for progressive jackpots.

Also, while the present method of play has been described in the context of a live casino table game, this method is easily applicable to other presentations. The method of the present invention could easily be utilized in a video machine having a display and interactive buttons for a player to access. Another example would be the use of the present wagering game as a computer video game using a standard personal computer or as a program on a computer server which is accessible by personal computers by means of an intranet or internet through the world wide web. The game could also be incorporated into a portable hand held gaming device.

In both the live table embodiment, as presented herein in detail, as well as the electronic versions, a plurality of games may be linked to create a common progressive jackpot. This would result in the progressive jackpot increasing very rapidly generating greater player excitement and interest in play.

Other examples of modifications that would not depart from the scope of the invention include: the hierarchy of potential hands and the hierarchy of winning hands; the rank dealer's hand must achieve in order to open play; the predetermined winning sum paid to a player on the ante wager; and, the predetermined payout schedules for winning and jackpot hands;

While the embodiments set forth in the preferred method of play have been described in detail, the scope of the appended claims is not limited to such specific details.

What we claim as our invention is:

1. A method of playing a casino card game involving one or more persons acting as dealer and banker, comprising the steps of:

(a) affording each player an opportunity to place an ante wager to participate in said card game;

(b) affording each player placing an ante wager an option of placing a jackpot wager that player's hand will match one of a predetermined schedule of hands, where a plurality of hands are ranked according to predetermined rules;

(c) the dealer, from a standard fifty-two card poker deck, dealing three cards face down to the player and three cards face down to the dealer;

(d) affording each player the opportunity to view only his first two cards, player's third card remaining face down;

(f) affording each player the option to either fold and lose their ante wager, or continue play by placing a second wager;

(g) the dealer revealing his three cards and if dealer's three-card hand does not meet or exceed a predetermined rank, player wins a predetermined amount based on the player's ante wager, player's second wager is returned without having been acted upon, and player's third card is revealed to settle jackpot wagers based on the rank of player's three-card hand according to a predetermined jackpot payout table;

(h) if dealer's hand does meet or exceed a predetermined rank, player's third card is revealed and dealer compares player's three-card hand to dealer's three-card hand;

(i) if dealer's hand rank is higher than player's hand, the player loses both player's ante wager and player's second wager;

(j) if player's hand rank is higher than dealer's hand, player wins a first predetermined amount on the player's ante wager and player wins a second predetermined amount on player's second wager; and, (k) whether dealer's hand wins or player's hand wins, dealer settles jackpot wagers based on the rank of player's three-card hand according to a predetermined jackpot payout table.

2. A method of playing a card game according to claim 1 wherein said hands are substantially ranked according to the following scale, where A=ace, K=king, Q=queen, J=jack and numbers 10 to 2 designate the remaining cards.

| | |
|---|---|
| HIGHEST: | AKQ of the same suit |
| | AK of the same suit with a non-suited Q |
| TRIPS (Three of same rank): | AAA highest ranking trips |
| | KKK next highest ranking trips, |
| | and so on, until . . . |
| | 222 lowest ranking trips |
| PAIR (Two of same rank): | AAK highest ranking pair hand |
| | AAQ next highest ranking pair hand |
| | and so on, until . . . |
| | 223 lowest ranking pair hand |
| HIGH CARD (Hand comprising None of the above): | A, non-suited K, and Q highest |
| | AKJ next highest |
| | AK10 next highest, |
| | and so on, until |
| | 432 lowest ranking hand |

3. A method of claim 1 wherein said jackpot and the payout table of said jackpot in steps (g) and (k) are comprised of fixed payouts.

4. A method of claim 3 where said jackpot and the payout table are comprised of fixed returns substantially according to the following table.

| Player's Three-Card Hand | Jackpot Amount |
|---|---|
| Ace, King, Queen suited with dealer Also having Ace, King, Queen suited | $10,000.00 |
| Ace, King, Queen suited | $800.00 |
| Ace, King suited with non-suited Queen | $200.00 |
| Three Aces | $150.00 |
| Three, 2's, 3's, or 4's | $50.00 |
| Any other three of a kind | $25.00 |
| Pair of 7's or higher | $5.00 |

5. A method of claim 1 wherein said jackpot and the payout table of said jackpot in steps (g) and (k) comprises a progressive jackpot.

6. A method of claim 5 wherein said progressive jackpot and said payout table are substantially comprised of the following.

| Player's Three-Card Hand | Jackpot Amount |
|---|---|
| Ace, King, Queen suited with dealer Also having Ace, King, Queen suited | 100% |
| Ace, King, Queen suited | $800.00 |
| Ace, King suited with non-suited Queen | $200.00 |
| Three Aces | $150.00 |
| Three, 2's, 3's, or 4's | $50.00 |
| Any other three of a kind | $25.00 |
| Pair of 7's or higher | $5.00 |

7. A method of claim 1, wherein said predetermined minimum rank of dealer's hand in steps (g) and (h) is a high card hand containing at least a jack.

8. A method of claim 1, wherein said predetermined amount paid to player on player's ante wager in steps (g) and (j) is even money.

9. A method of claim 1, wherein player's second wager in step (f) is twice the ante wager.

10. A method of claim 1 wherein the second predetermined amount paid on player's second wager in step (j) consists of an additional payout to player when player's hand matches specific predetermined high ranking hands.

11. A method of playing a card game according to claim 10 wherein player's second wager is paid substantially according to the following payout table based on the rank of player's hand.

| Winning Hand | Amount |
|---|---|
| Ace, King, Queen suited | 30 to 1 |
| Ace, King suited with non-suited Queen | 12 to 1 |
| Three of a kind | 8 to 1 |

-continued

| Winning Hand | Amount |
|---|---|
| One pair | 2 to 1 |
| All other winning hands | 1 to 1 |

* * * * *